United States Patent [19]

Kogure

[11] Patent Number: 4,732,032

[45] Date of Patent: Mar. 22, 1988

[54] DIE CROWNING APPARATUS FOR PRESS BRAKE

[75] Inventor: Tsuneo Kogure, Hatano, Japan

[73] Assignee: Amada Company, Limited, Japan

[21] Appl. No.: 29,664

[22] Filed: Mar. 24, 1987

[30] Foreign Application Priority Data

Mar. 25, 1986 [JP] Japan ..... 61-064837

[51] Int. Cl.[4] ..... B21D 5/02

[52] U.S. Cl. ..... 72/389; 77/446; 100/46

[58] Field of Search ..... 72/389, 448, 465, 386, 72/446, 447, 462, 380; 100/46

[56] References Cited

U.S. PATENT DOCUMENTS

| | | | |
|---|---|---|---|
| 3,587,286 | 6/1971 | Fritsch | 72/389 |
| 3,965,721 | 6/1976 | Roch | 72/389 |
| 4,426,873 | 1/1984 | Pearson et al. | 72/389 |
| 4,449,389 | 5/1984 | Cros | 72/389 |
| 4,586,361 | 5/1986 | Reinhorn et al. | 72/389 |

*Primary Examiner*—Robert L. Spruill
*Assistant Examiner*—David B. Jones
*Attorney, Agent, or Firm*—Wigman & Cohen

[57] ABSTRACT

To crown (deform into a convex state) a die for a press brake (bending press), a number of a pair of upper and lower wedges are arranged between the lower die and the lower table at intervals along the longitudinal direction of the press brake, and simultaneously moved in the lateral direction by an elastic member (plate spring) fitted to each bottom groove formed in the lower wedge. Both free ends of the elastic member is moved by elastic member adjusting means including two sprocket wheels, two tubular nut members, a control motor, etc. To provide a smooth wedge slidable motion, springs are disposed to urge the lower die upward together with a lower die base.

5 Claims, 6 Drawing Figures

DIE CROWNING APPARATUS FOR PRESS BRAKE

BACKGROUND OF THE INVENTION

1. Field of the Invention

The present invention relates to a die crowning apparatus for a press brake and more specifically to an apparatus for adjusting the curvature of a die so that a pair of upper and lower dies are parallel to each other all over the length of the press brake during workpiece bending process. Here, "Crowning" implies to form something into an upwardly convex state and "press brake" implies a press for bending a long workpiece at an angle.

2. Description of the Prior Art

As is well known, a press brake is provided with an upper table for supporting an upper die and a lower table for supporting a lower die so as to face each other, both ends of each of the upper and lower tables being supported by two side frames. A sheet (workpiece) disposed between the two dies is bent when any one of the upper and lower tables (ram) is moved up and down by a drive unit via a crankshaft, hydraulic cylinder, etc. so as to engage the two dies with each other.

In the above bending processing of a sheet-like workpiece, it is well known that the upper and lower tables are deformed or curved in the vertical direction. This is because the two tables are supported at both the extreme ends thereof by the two frames; a drive unit for moving one of the tables up and down is provided on either side; and there exists a reaction of a sheet workpiece generated when the sheet is being bent. That is, the upper table tends to deform upward at the middle along the longitudinal direction of the brake press and the lower table tends to deform downward also at the middle therealong. In case the upper and lower tables are deformed or curved, there arises a problem such that the two upper and lower dies are not engaged with each other accurately near the middle of the tables and therefore a bending angle at the middle of a sheet to be bent is different (e.g. bending angle is large) from that at both the ends of the sheet.

To overcome the above-mentioned problem, various methods or apparatus have been so far proposed to obtain a uniform bending angle all over a long sheet-like workpiece by engaging the two dies in parallel with each other all over the dies.

For instance, a plurality of wedge members are arranged between the upper table and the upper die or between the lower table and the lower die. In this first example, each of the wedge members should be adjusted in position independently to obtain an appropriate crown or convex state of the die, thus resulting in a complicated adjustment work and a low workability.

Further, a plurality of wedge members are engaged with a common slidable member so that all the wedge members can be adjusted in position by moving the slidable member. Or else, a plurality of wedge adjust screws are associated with the wedge members, respectively so that all the wedge member can be adjusted by rotating all the adjust screws simultaneously. In this second example, it is necessary to prepare different kinds of wedges having different slope angles respectively, or to adjust screws having different pitches, thus resulting in complicated manufacturing processes.

Furthermore, a plurality of minicylinders are provided horizontally for the upper table or the lower table to bend the middle portion of the table upwardly. In this third example, a number of minicylinders and pressure regulation valves are required, thus resulting in a higher manufacturing cost and a complicated cylinder pressure setting work.

SUMMARY OF THE INVENTION

With these problems in mind, therefore, it is the primary object of the present invention to provide a die crowning apparatus for a press brake which can readily and adjustably realize the crown or convex state of the die so that a pair of the upper and lower dies can be deformed or curved in parallel relationship to each other all over the longitudinal length of the press brake.

To achieve the above-mentioned object, a die crowning apparatus for a press having an upper die attached to an upper table and a lower die mounted on a lower die, according to the present invention, comprises; (a) a plurality of sets of upper wedge member and lower wedge member arranged between the lower die and the lower table at intervals along a longitudinal direction of the press brake, the lower wedge members being slidable in a lateral direction of the press brake to adjust a height of the two engaged upper and lower wedge members; (b) an elastic member extending in the longitudinal direction and deformable in the lateral direction of the brake press, said elastic member being fixed to the lower table at the middle thereof and engaged with said lower wedge members near both free ends of said elastic member; and (c) means for adjusting a curvature of said elastic member by bending both the free ends of said elastic member in symmetrical contilever fashion to adjust the height of said two wedge members so that the lower die mounted on the lower table is deformable into a convex state in parallel to the upper die attached to the upper table all over the length of the press brake when the two dies are engaged with each other.

A plurality of sets of the upper and lower wedge members can be arranged between the upper die and the upper table, so that the upper wedge members are slidable in the lateral direction of the press brake to adjust the height of the two engaged upper and lower wedge members.

The elastic member curvature adjusting means comprises (a) a control motor; (b) a pair of chain sprocket wheels disposed at both the ends of the press brake and driven by said control motor via a chain; and (c) a pair of tubular nut members each linked with the free an end of said elastic member and driven by said chain sprocket wheel via a screw member.

The slidable wedge member is moved along a guide member. Further, a plurality of springs are provided for urging the lower die away from said wedge members to allow the lower wedge to slide smoothly relative to the mate upper die.

BRIEF DESCRIPTION OF THE DRAWINGS

The features and advantages of the die crowning apparatus according to the present invention will be more clearly appreciated from the following description of the preferred embodiment of the invention taken in conjunction with the accompanying drawings in which like reference numerals designate the same or similar elements or sections throughout the figures thereof and in which.

DESCRIPTION OF THE PREFERRED EMBODIMENTS

Figure 1:
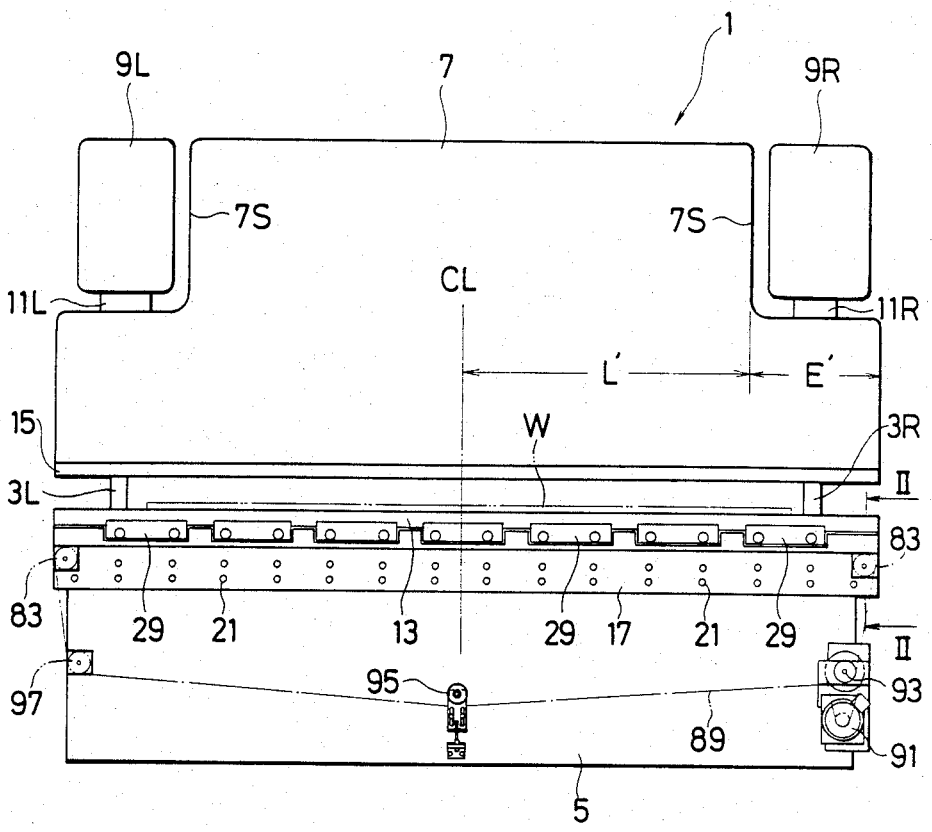
FIG. 1 is a diagrammatical entire front view showing a press brake to which the die crowning apparatus according to the present invention is applied.

With reference to FIG. 1, a press brake to which a die crowning apparatus for forming a die into a convex state according to the present invention is applied comprises a pair of C-shaped right and left side frames 3R and 3L, a lower table 5 extending in the longitudinal (right and left) direction of the press brake 1, and an upper table 7 also extending in the longitudinal direction so as to face the lower table 5, both the tables being supported by the two side frames 3R and 3L. In the above press brake 1, the lower table 5 is moved up and down in some models, while the upper table 7 is moved up and down in the other models. The apparatus of the present invention will be described by taking the case of the upper movable table type; however, the apparatus can also be applied to the lower movable table type.

To move the upper table up and down, a pair of hydraulic cylinders 9R and 9L are mounted on the two side frames 3R and 3L and connected to the upper table 7 via two piston rods 11R and 11L. Further, the upper table 7 is formed into a short and thick T-shape having two rising portions 7S in order to reduce the deformation when a load is applied thereto during bending process.

To bend a sheet workpiece W, a lower die 13 is mounted on the upper portion of the lower table 5, and an upper die 15 is attached to the lower portion of the upper table 7 so as to cooperate with the lower die 13.

In the above construction, after a sheet workpiece W has been mounted on the lower die 13, the upper table 7 is lowered by operating the hydraulic cylinders 9R and 9L to bend the sheet workpiece W at an angle by engagement between two upper and lower dies 13 and 15.

In the above bending process of the sheet workpiece W, the upper table 7 tends to deform upward at the middle thereof and downward on both the outsides of the rising portion 7S of the upper table 7 as is well known. Therefore, in order to previously crown (deform into a convex state) the lower die 13 so that the lower die 13 uniformly mates with the upper die 15, it is necessary to take into account the position of the upper table rising portion 7S and the deformation degree outside the rising portion 7S.

Figure 2:
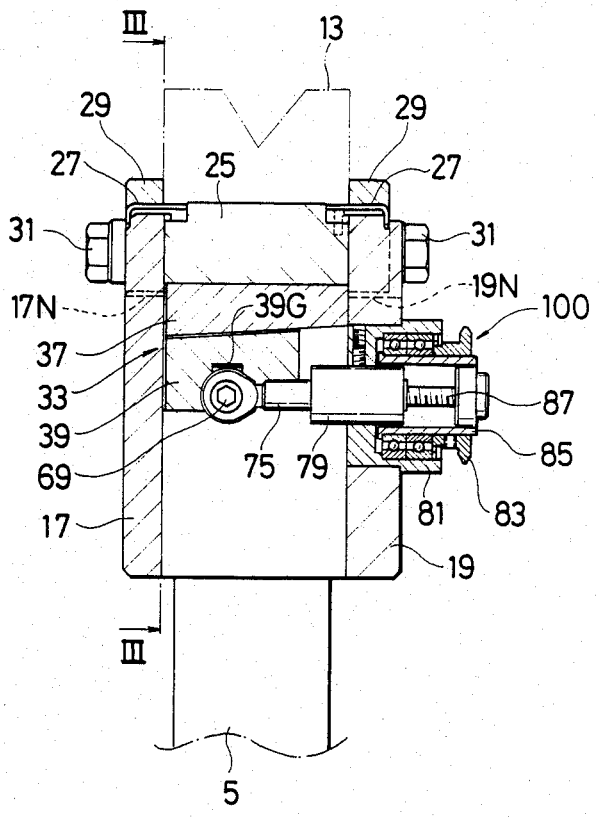
FIG. 2 is an enlarged cross-sectional (side) view taken along the line II—II shown in FIG. 1.
Figure 4:
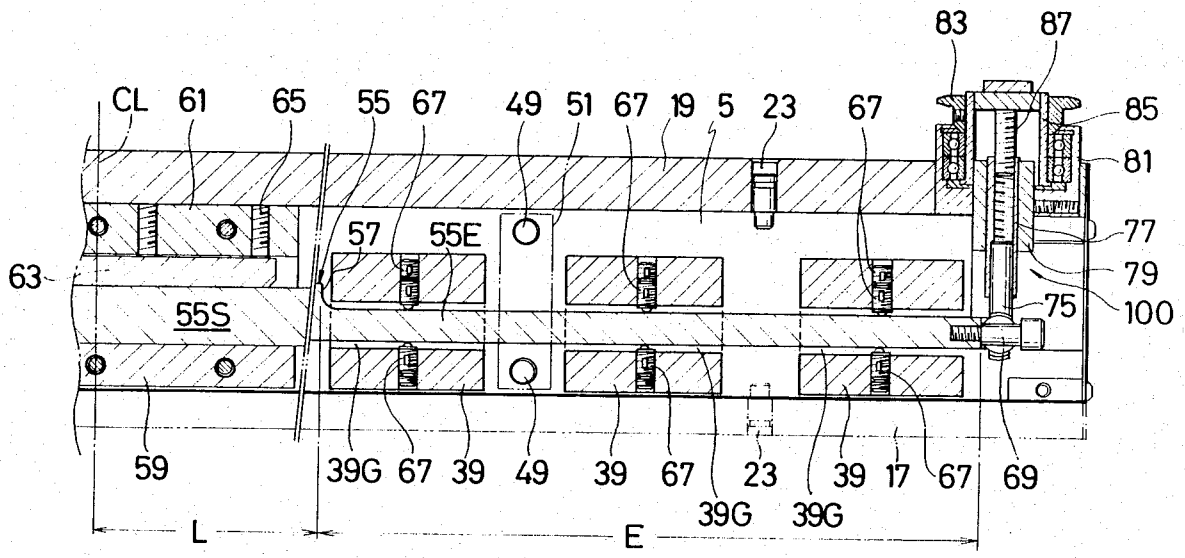
FIG. 4 is an enlarged cross-sectional (top) view taken along the line IV—IV shown in FIG. 3.

As depicted in FIG. 2 (side view) and FIG. 4 (top view), a front plate 17 and a rear plate 19 extending in the longitudinal direction of the press brake and fixed to the upper portion of the lower table 5 with bolts 21 in such a way as to project from the top surface of the lower table 5. A plurality of rotatable eccentric pins 23 (shown in FIG. 4) are arranged along the longitudinal direction of both the front and rear plates 17 and 19 in such a way that the eccentric outer surface thereof is in contact with the top surface of the lower table 5. Therefore, it is possible to finely adjust the vertical position of the two plates 17 and 19, separately by rotating the eccentric pins 23 before fixing the two plates 17 and 19 to the lower table 5.

Figure 3:
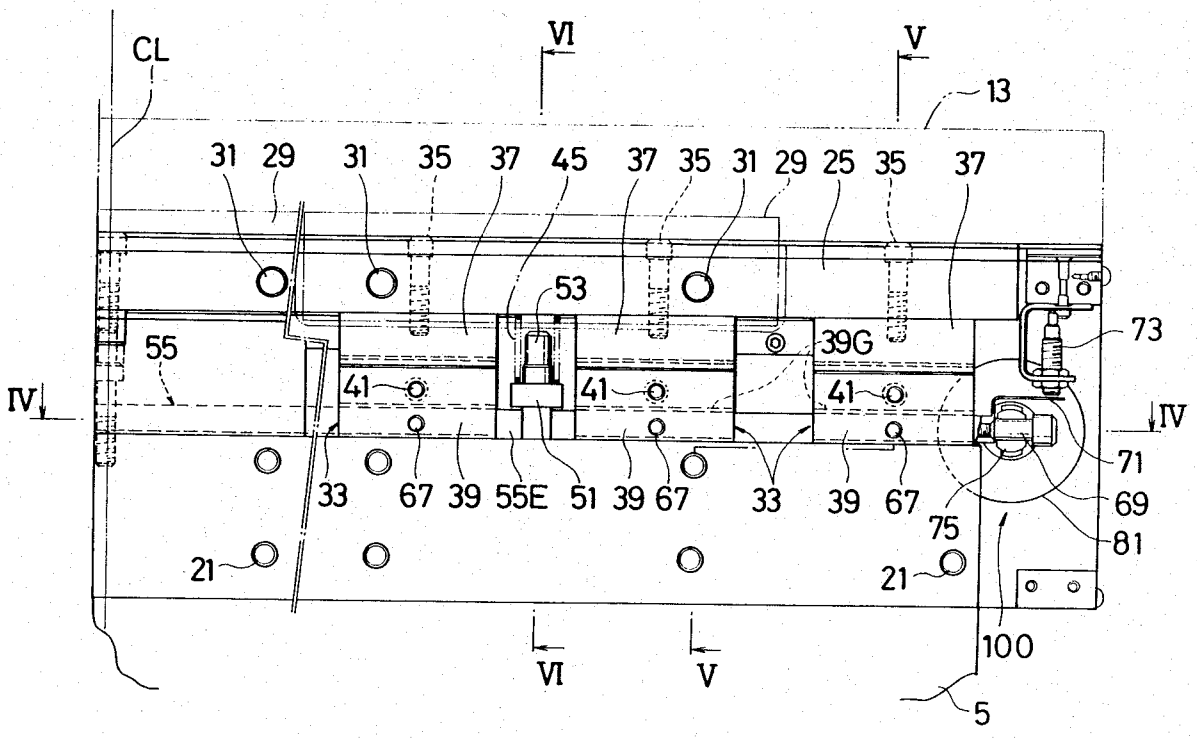
FIG. 3 is an enlarged partial cross-sectional (front) view taken along the line III—III shown in FIG. 2, in which only the right side of the press brake thereof is shown.

As depicted in FIGS. 2 and 3, a lower die base 25 extending over the whole length of the lower table 5 is vertically movably sandwiched between the front plate 17 and the rear plate 19. The lower die 13 (shown by dot-dot-dashed lines) is mounted on this lower die base 25. Two cover plates 27 (shown in FIGS. 2 and 3) for covering the front plate 17 and the rear plate 19, respectively are mounted on the front and rear side of the top surface of the lower die base 25. Further, a plurality of lower die fixing plates 29 (FIG. 2) for fixing the lower die 13 mounted on the lower die base 25 from the front and rear sides of the press brake are fixed to the lower die base 25 with bolts 31 at regular intervals along the longitudinal direction of the lower die base 25. The numerals 17N and 19N shown by dashed lines in FIG. 2 denote cutouts formed in the front plate 17 and the rear plate 19, respectively to prevent the interference thereof with the lower die fixing plates 29. Therefore, the lower die 13 fixed to the lower die base 25 by the plural lower die fixing plates 29 and bolts 31 can be moved up and down together with the lower die base 25, where necessary.

Figure 5:
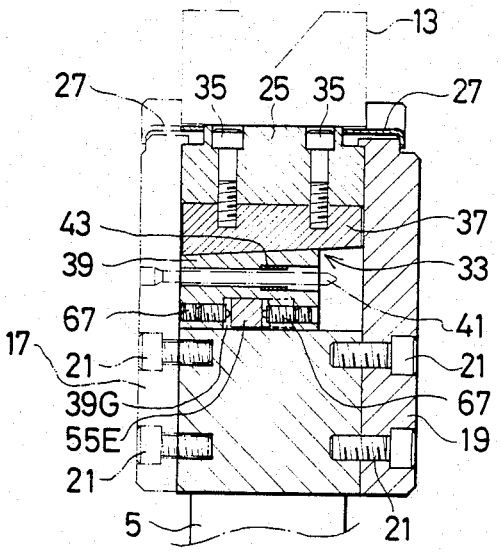
FIG. 5 is an enlarged cross-sectional (side) view taken along the line V—V shown in FIG. 3.

In order to adjust the crowning condition (die convex condition) of the lower die 13, that is, to adjust the plural vertical positions of the lower die 13 along the longitudinal direction thereof, a plurality of wedge devices 33 are arranged between the lower surface of the lower die 25 and the upper surface of the lower table 5 at regular intervals along the longitudinal direction of the lower table 5, as shown in FIGS. 2, 3 and 5.

As depicted in FIG. 5 each wedge device 33 is composed of an upper wedge member 37 fixed to the bottom surface of the lower die base 25 with bolts 35 and a lower wedge member 39 in slidable contact with the upper wedge member 37. The bottom surface of the upper wedge member 37 and the top surface of the lower wedge member 39 are formed being sloped rearside up or frontside down as depicted in FIGS. 2 and 5. Therefore, it is possible to adjust the top surface position of the upper wedge member 37 up and down by moving the lower wedge member 39 to and fro in the lateral (front and rear) direction of the press brake in FIG. 2 or 5. As already understood, the lower die base 25 and the lower die 13 are adjustable in height into a crown (convex) state by adjusting position of each lower wedge member 39 in different way to adjust the height of each upper wedge member 37 mated with the lower wedge member 39.

To guide the lower wedge member 39 in the front and rear direction, a plurality of guide pins 41 are supported in cantilever fashion as guide members, at intervals along the longitudinal direction of the front plate 17, as depicted in FIG. 5. The guide pin 41 passes through the lower wedge member 39 and slidably supports the lower wedge member 39 via linear ball bearings.

To smoothly move the lower wedge member 39 to and fro, the upper wedge member 37 fixed to the lower die base 25 is so constructed as to be urged away from the lower wedge member 29 by coil springs 45. These springs 45 are strong enough to bring up the lower die base 25 and the lower die 13, and arranged between two adjacent wedge device 33 as shown in FIGS. 3 and 6.

Figure 6:
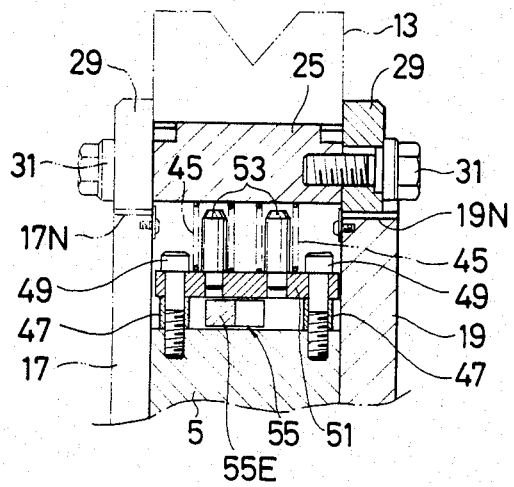
FIG. 6 is an enlarged cross-sectional (side) view taken along the line VI—VI shown in FIG. 3.

In more detail, in FIG. 6 a plurality of spring seat plates 51 are fixed to the lower table 5 each via a spacer with bolts 49 between two adjacent wedge members 33. Each coil spring 45 is elastically mounted between the spring seat plate 51 and the lower base 25 being guided by a pin 53 vertically disposed on the spring seat plate 51.

Therefore, the lower base 25 is always urged upward by the coil spring 45 to reduce the contact pressure between the upper and lower wedge members 37 and 39 under no-load condition for providing a smooth slidable motion of the lower wedge member 29 in the lateral (front and rear) direction of the press brake.

As depicted in FIG. 4, a long elastic member 55 of plate spring is mounted on the upper surface of the lower table 5 so as to be deformable in symmetrical cantilever fashion, that is, to simultaneously adjust the positions of the plural lower wedge members 39 in the lateral direction of the press. This elastic member 55 extends in the longitudinal direction of the press so as to pass through each groove 39G (FIG. 5) formed in the bottom surface of each lower wedge member 39.

Therefore, when this elastic member 55 is bent or deformed in the lateral direction of the press, the plural lower wedge members 39 are also moved in the lateral direction all together along the elastic member 55, so that the convex state of the lower die 13 is determined in accordance with the degree of curvature of the elastic member 55.

As depicted in FIG. 4 (top view), the elastic member 55 is formed symmetrical with respect to the center of the press and extending in the longitudinal direction of the press. The middle portion 55S thereof is fixed to the lower table 5. The thickness of this elastic member 55 (when seen from above) is thick near the middle portion 55S but thin on both the sides 55E thereof with each stepped portion 57 as a boundary. The distance L between the central line CL of the elastic member 55 to the stepped portion 57 thereof is roughly equal to that L' (FIG. 1) between the central line CL of the press brake 1 to the rising portion 7S of the upper table 7. Further, the distance E between the stepped portion 57 of the elastic member 57 to the end thereof is roughly equal to that E' (FIG. 1) between the rising portion 7S of the upper table 7 to the end thereof.

The central portion 55S of the elastic member 55 is fixed on the central upper surface of the lower table 5 and between two fixing blocks 59 and 61 (FIG. 4) via a fixing member 63. That is, this fixing member 63 is pushed against the elastic member 55 by fixing screws 65 screwed in the rear fixing block 61 to fixedly sandwich the middle portion 55S of the elastic member 55 between the fixing block 59 and the fixing member 63.

As already explained, the elastic member 55 is engaged with a plurality of the lower wedge members 39 to simultaneously adjust the positions of the wedge members 39 in the lateral direction (front and rear direction) of the press. Further, the middle portion 55S and the side portions 55E of the elastic member 55 are passed through each groove 39G formed in the bottom surface of each lower wedge member 39 (the side portion of the member 55 passing through the wedge 39 is shown in FIG. 5, but the middle portion of the member 55 passing through the wedge 39 is not shown). As depicted in FIG. 4, both the side portions 55E of the elastic member 55 are supported between a plurality of balls of ball plungers 67 fixed via thread to the lower wedge members 39. Therefore, when the elastic member 55 is curved in the lateral direction of the press, each lower wedge member 39 is moved in the same direction in accordance with the curvature of the elastic member 55 for providing wedge position adjustment.

To adjust the curvature of the elastic member 55 in the lateral direction of the press brake, a curvature adjusting device 100 is arranged, as shown in FIGS. 3 and 4. A bolt 69 is mounted at the end of the elastic member 55 to support a sensed member 71. Just over the sensed member 71, a vicinity switch sensor 73 is positioned to sense a reference position of the elastic member 55 (e.g. this sensor 73 is deactivated when the elastic member 55 is moved away from under the sensor 73). A ball joint 75 is rotatably linked with the bolt 69 at one end thereof and fixed to a tubular nut member 77 at the other end thereof. This nut member 77 is movably supported by a hollow cylindrical holder 79 supported by a bearing block 81 fixed to the lower table 5. A cylindrical member 85 integral with a chain sprocket wheel 83 is rotatably supported by this bearing block 81. An adjust screw 87 fixed to the axial center of the cylindrical member 85 is engaged with the tubular nut member 77.

Therefore, when the chain sprocket wheel 83 is rotated, since the thread engagement relationship between the adjust screw 87 and the tubular nut member 77 is adjusted, the free end position of the elastic member 55 is moved to and fro in the lateral direction of the press brake in symmetrical cantilever fashion to adjust the curvature of the elastic member 55.

To simultaneously adjust the position of both the free ends of the elastic members 55, as depicted in FIG. 1, an endless chain 89 is reeved around the two chain sprocket wheels 83 disposed on both the ends of the lower table 5 via a drive sprocket wheel 93 disposed at one end of the lower table 5 and driven by a control motor 91, a tension sprocket wheel 95 disposed at the middle of the lower table 5, and an intermediate sprocket wheel 97 disposed at the end of the lower table 5.

Therefore, when the control motor 91 is driven, the two chain sprocket wheels 83 are rotated via the chain 89 to simultaneously adjust both the free end positions of the elastic member 55 for adjustment of the elastic member curvature, so that each lower wedge member 39 is moved in the lateral direction of the press brake. Since the engagement relationship between the upper and lower wedge members 37 and 39 is adjusted, the vertical position of the upper wedge member 37 is adjusted and therefore the convex state of the lower die 13 can be changed.

In practical operation, when the sensor (vicinity switch) 73 detects the reference position at which the sensed member 71 is located just under the sensor 73, the chain sprocket wheels 83 are rotated to move both the free ends of the elastic member 55 simultaneously. Then, both the free ends of the elastic member 55 are deformed or curved rearward with the middle portion 55S thereof as its fulcrum. Here, since the elastic member 55 is formed with two stepped portions 57 (FIG. 4), both the free ends of the elastic member 55 are curved rearward starting from the stepped portion 57. Therefore, a plurality of lower wedge members 39 are continuously and gradually moved rearward beginning from the stepped portion 57 toward the free ends of the elastic member 55. Therefore, the upper wedge members 37 are lowered when the upper table 7 is lowered to bend a sheet workpiece W; that is, it is possible to obtain a crowning (convex) state of the lower die 13 such that both the ends of the lower die 13 are sloped down from the position corresponding to the rising portion 7S of the upper table 7. Therefore, it is possible to deform the lower die 13 into a convex shape along the upper die 15 when both the dies are mated to bend a workpiece. In other words, it is possible to parallel the lower die 13 with the upper die 15 all over the longitudinal length of the dies, thus permitting a uniform bending processing all over the sheet workpiece W.

As described above, in the die crowning apparatus according to the present invention, since the positions of a plurality of wedge members can be adjusted simultaneously, it is possible to readily realize a convex state of the dies so that the dies can be adjusted so as to match the deformed upper table.

What is claimed is:

1. A die crowning apparatus for a press brake having an upper die (15) attached to an upper table (7) and a lower die (13) mounted on a lower table (5), which comprises:

(a) a plurality of sets of upper wedge member (37) and lower wedge member (39) arranged between the lower die and the lower table at intervals along a longitudinal direction of the press brake, the lower wedge members being slidable in a lateral direction of the press brake to adjust a height of the engaged upper wedge member;

(b) an elastic member (55) extending in the longitudinal direction and deformable in the lateral direction of the press brake, said elastic member being fixed to the lower table at the middle thereof and engaged with each groove (39G) formed in a bottom surface of each of said lower wedge members near both free ends of said elastic member positioned on both longitudinal ends of the press brake; and (c) means (100) for adjusting a curvature of said elastic member by bending both the free ends of said elastic member in symmetrical cantilever fashion to adjust the height of said upper wedge members in contact with the lower die so that the lower die mounted on the lower table is deformable into a convex state in parallel to the upper die attached to the upper table all over the length of the press brake when the two dies are engaged with each other.

2. A die crowning apparatus for a press brake having an upper die (15) attached to an upper table (7) and a lower die (13) mounted on a lower table (5), which comprises;

(a) a plurality of sets of upper wedge members (37) and lower wedge member (39) arranged between the upper die and the upper table at intervals along a longitudinal direction of the press brake, the upper wedge member being slidable in a lateral direction of the press brake to adjust a height of the engaged lower wedge member;

(b) an elastic member (55) extending in the longitudinal direction and deformable in the lateral direction of the press brake, said elastic member being fixed to the upper table at the middle thereof and engaged with each groove formed in a top surface of each of said upper wedge members near both free ends of said elastic member positioned on both longitudinal ends of the press brake; and (c) means (100) for adjusting a curvature of said elastic member of bending both the free ends of said elastic member in symmetrical cantilever fashion to adjust the height of said lower wedge members in contact with said upper die so that the upper die mounted on the upper table is deformable into a convex state in parallel to the lower die attached to the lower table all over the length of the press brake when the two dies are engaged with each other.

3. The die crowning apparatus as set forth in claim 1, wherein said elastic member curvature adjusting means comprises:

(a) a control motor (91) located on one side of the lower table (5);

(b) a pair of chain sprocket wheels (83) disposed at both the ends of said press brake and driven by said control motor via a chain; and (c) a pair of tubular nut members (77) movably supported by the lower table, one end of each of said tubular nut members being linked with the free end of said elastic member and the other end thereof being engaged with a screw member (87) driven by said chain sprocket wheel.

4. The die crowning apparatus for a press brake as set forth in claim 1, wherein said lower wedge is slidable in the lateral direction of the press brake being guided along a guide member (41) supported in cantilever fashion by a front plate (17), said guide member passing through said lower wedge member to slidably support said lower wedge member via linear ball bearings.

5. The die crowning apparatus for a press brake as set forth in claim 1, which further comprises a plurality of springs (45) disposed between the lower table (5) and a lower die base (25) for urging the lower die and the lower die base (25) together away from said wedge members to allow the lower wedge to slide smoothly.

* * * * *